US011495396B2

(12) United States Patent
Koike

(10) Patent No.: US 11,495,396 B2
(45) Date of Patent: Nov. 8, 2022

(54) SURFACE MOUNT INDUCTOR

(71) Applicant: Murata Manufacturing Co., Ltd., Kyoto-fu (JP)

(72) Inventor: Masato Koike, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 641 days.

(21) Appl. No.: 16/404,521

(22) Filed: May 6, 2019

(65) Prior Publication Data

US 2019/0348215 A1 Nov. 14, 2019

(30) Foreign Application Priority Data

May 8, 2018 (JP) ..... JP2018-090126

(51) Int. Cl.
*H01F 27/02* (2006.01)
*H01F 27/29* (2006.01)
(Continued)

(52) U.S. Cl.
CPC ..... *H01F 27/292* (2013.01); *H01F 27/255* (2013.01); *H01F 27/327* (2013.01)

(58) Field of Classification Search
CPC ..... H01F 2017/048; H01F 27/255; H01F 27/292; H01F 27/327
(Continued)

(56) References Cited

U.S. PATENT DOCUMENTS 10,446,313 B2 * 10/2019 Kawarai ..... H01F 27/00
2002/0053967 A1 5/2002 Shikama et al.
(Continued)

FOREIGN PATENT DOCUMENTS

CN 1722318 A 1/2006
CN 104700991 A 6/2015
(Continued)

OTHER PUBLICATIONS

An Office Action mailed by China National Intellectual Property Administration dated Apr. 30, 2021, which corresponds to Chinese Patent Application No. 201910338475.4 and is related to U.S. Appl. No. 17/404,521 with English language translation.
(Continued)

*Primary Examiner* — Ronald Hinson
(74) *Attorney, Agent, or Firm* — Studebaker & Brackett PC

(57) ABSTRACT

A surface mount inductor includes a coil including a winding portion and extension portions that extend from the outer circumference of the winding portion, a molded body which contains a metal magnetic powder and in which the coil is embedded, and outer terminals. The molded body is a rectangular parallelepiped. Each end portion in the longitudinal direction of the principal surface has an outer terminal connected to the extension portion. A resin coating is formed on the molded body except regions in which the outer terminals are provided, and $W_1$ is less than $W_0$, where the width between ridges opposite to each other in a lateral direction of the principal surface is denoted as $W_0$ and the width of each outer terminal in the lateral direction is denoted as $W_1$, and neither end in the width direction of each outer terminal is in contact with the ridges.

6 Claims, 2 Drawing Sheets

(51) Int. Cl.
*H01F 27/32* (2006.01)
*H01F 27/255* (2006.01)

(58) Field of Classification Search
USPC ..... 336/192, 233
See application file for complete search history.

(56) References Cited

U.S. PATENT DOCUMENTS

| | | | | |
|---|---|---|---|---|
| 2006/0006972 | A1 | 1/2006 | Tozawa et al. | |
| 2012/0274432 | A1* | 11/2012 | Jeong | H01F 17/0033 336/192 |
| 2013/0307655 | A1 | 11/2013 | Saito et al. | |
| 2014/0218157 | A1* | 8/2014 | Liu | H01F 27/2828 336/192 |
| 2016/0141093 | A1 | 5/2016 | Jeong | |
| 2017/0178793 | A1 | 6/2017 | Muneuchi | |
| 2017/0207018 | A1* | 7/2017 | Jung | H01F 41/041 |
| 2018/0247764 | A1 | 8/2018 | Muneuchi et al. | |

FOREIGN PATENT DOCUMENTS

| | | | |
|---|---|---|---|
| CN | 104810130 | A | 7/2015 |
| CN | 105609233 | A | 5/2016 |
| JP | H11-288824 | A | 10/1999 |
| JP | 2001-155950 | A | 6/2001 |
| JP | 2006-032430 | A | 2/2006 |
| JP | 2009-267350 | A | 11/2009 |
| JP | 2010-147272 | A | 7/2010 |
| JP | 2010-186909 | A | 8/2010 |
| JP | 2012-079870 | A | 4/2012 |
| JP | 2012-160507 | A | 8/2012 |
| JP | 2014-175437 | A | 9/2014 |
| JP | 2016-058418 | A | 4/2016 |
| WO | 2016/121575 | A1 | 8/2016 |
| WO | 2017/135058 | A1 | 8/2017 |

OTHER PUBLICATIONS

An Office Action; "Decision of Refusal," mailed by the Japanese Patent Office dated May 25, 2021, which corresponds to Japanese Patent Application No. 2018-090126 and is related to U.S. Appl. No. 16/404,521 with English language translation.

An Office Action mailed by the Japanese Patent Office dated May 25, 2021, which corresponds to Japanese Patent Application No. 2018-080126 and is related to U.S. Appl. No. 16/404,521 with English language translation.

An Office Action; "Notice of Reasons for Refusal," mailed by the Japanese Patent Office dated Jan. 12, 2021, which corresponds to Japanese Patent Application No. 2018-090126 and is related to U.S. Appl. No. 16/404,521 with English language translation.

An Office Action; "Notice of Reasons for Refusal," mailed by the Japanese Patent Office dated Oct. 6, 2020, which corresponds to Japanese Patent Application No. 2018-090126 and is related to U.S. Appl. No. 16/404,521 with English language translation.

* cited by examiner

SURFACE MOUNT INDUCTOR

CROSS-REFERENCE TO RELATED APPLICATION

This application claims benefit of priority to Japanese Patent Application No. 2018-090126, filed May 8, 2018, the entire content of which is incorporated herein by reference.

BACKGROUND

Technical Field

The present disclosure relates to a surface mount inductor. In particular, the present disclosure relates to a surface mount inductor in which at least one coil is embedded in a molded body.

Background Art

Regarding surface mount inductors used for power inductors, for example, a surface mount inductor in which a coil formed by winding a conducting wire is embedded in a molded body containing a metal magnetic powder is used. In a known surface mount inductor, for example, a coil including a winding portion and extension portions is used. The winding portion is formed by winding a conducting wire such that both ends are located on the outer circumference, and the extension portions extend from the outer circumference of the winding portion. The end portions of the extension portions of the coil extend to the side surfaces of the molded body, and the end portions of the extension portions are connected to outer terminals formed on the side surfaces and to the mounting surface adjacent to the side surfaces of the molded body, as described, for example, in Japanese Unexamined Patent Application Publication No. 2009-267350.

Surface mount inductors in the related art have a problem in that it is difficult to ensure a sufficient withstand voltage because a metal magnetic powder having a poor insulating property is used for a molded body.

SUMMARY

Accordingly, the present disclosure provides a surface mount inductor having an improved withstand voltage.

A surface mount inductor according to preferred embodiments of the present disclosure includes a coil including a winding portion and first and second extension portions. The winding portion is formed by winding a conducting wire, and the first and second extension portions extend from the outer circumference of the winding portion. The surface mount inductor further includes a molded body which contains a metal magnetic powder and in which the coil is embedded, and outer terminals disposed on the molded body. The molded body is in the shape of a substantially rectangular parallelepiped having a substantially rectangular first principal surface and a substantially rectangular second principal surface opposite to each other and four side surfaces. One end portion in the longitudinal direction of the first principal surface has a first outer terminal connected to the end portion of the first extension portion, and the other end portion has a second outer terminal connected to the end portion of the second extraction portion. A resin coating is formed on the surface of the molded body excluding regions provided with the first outer terminal and the second outer terminal. The value of $W_1$ is less than the value of $W_0$, where the distance between a first ridge and a second ridge opposite to each other in a lateral direction of the first principal surface of the molded body provided with the resin coating is denoted as $W_0$, and the dimension of the first outer terminal or the second outer terminal in the lateral direction of the first principal surface of the molded body provided with the resin coating is denoted as $W_1$. Also, neither end in the lateral direction of each of the first outer terminal and the second outer terminal is in contact with the first ridge or the second ridge.

According to the above-described aspect, the withstand voltage of the surface mount inductor can be improved.

Other features, elements, characteristics and advantages of the present disclosure will become more apparent from the following detailed description of preferred embodiments of the present disclosure with reference to the attached drawings.

DETAILED DESCRIPTION

The embodiment according to the present disclosure will be described below with reference to the drawings and the like.

A surface mount inductor according to the present embodiment includes a coil including a winding portion and first and second extension portions. The winding portion is formed by winding a conducting wire, and the first and second extension portions extend from the outer circumference of the winding portion. The surface mount inductor further includes a molded body which contains a metal magnetic powder and in which the coil is embedded, and outer terminals disposed on the molded body. The molded body is in the shape of a substantially rectangular parallelepiped having a first principal surface and a second principal surface opposite to each other and four side surfaces. One end portion in the longitudinal direction of the first principal surface has a first outer terminal connected to the end portion of the first extension portion, and the other end portion has a second outer terminal connected to the end portion of the second extraction portion. A resin coating is formed on the surface of the molded body except in regions in which the first outer terminal and the second outer terminal are provided. The value of $W_1$ is less than the value of $W_0$, where the width between a first ridge and a second ridge opposite to each other in the lateral direction of the first principal surface of the molded body provided with the resin coating is denoted as $W_0$, and the width of each of the first outer terminal and the second outer terminal in the lateral direction of the first principal surface of the molded body provided with the resin coating is denoted as $W_1$. Also, neither end in the lateral direction of each of the first outer terminal and the second outer terminal is in contact with the first ridge or the second ridge.

In another aspect, $W_1$ is about 55% or more and 95% or less (i.e., from about 55% to 95%) of $W_0$. According to the this aspect, the withstand voltage can be improved while the connection strength between the mounting substrate and the outer terminal is ensured.

In another aspect, a conductor is attached to at least one of the vicinity of the first ridge of the first principal surface and the vicinity of the second ridge. According to this aspect, even when the conductor is present in the vicinity of the ridge, the withstand voltage can be improved while the connection strength between the mounting substrate and the outer terminal is ensured.

In another aspect, the coil is embedded in the molded body such that the winding axis of the coil becomes parallel to the first principal surface of the molded body. According to this aspect, complex processing, for example, twisting, of the end portion of the extension portion is unnecessary and, thereby, variations in product quality can be suppressed and reliability can be improved.

Figure 1:
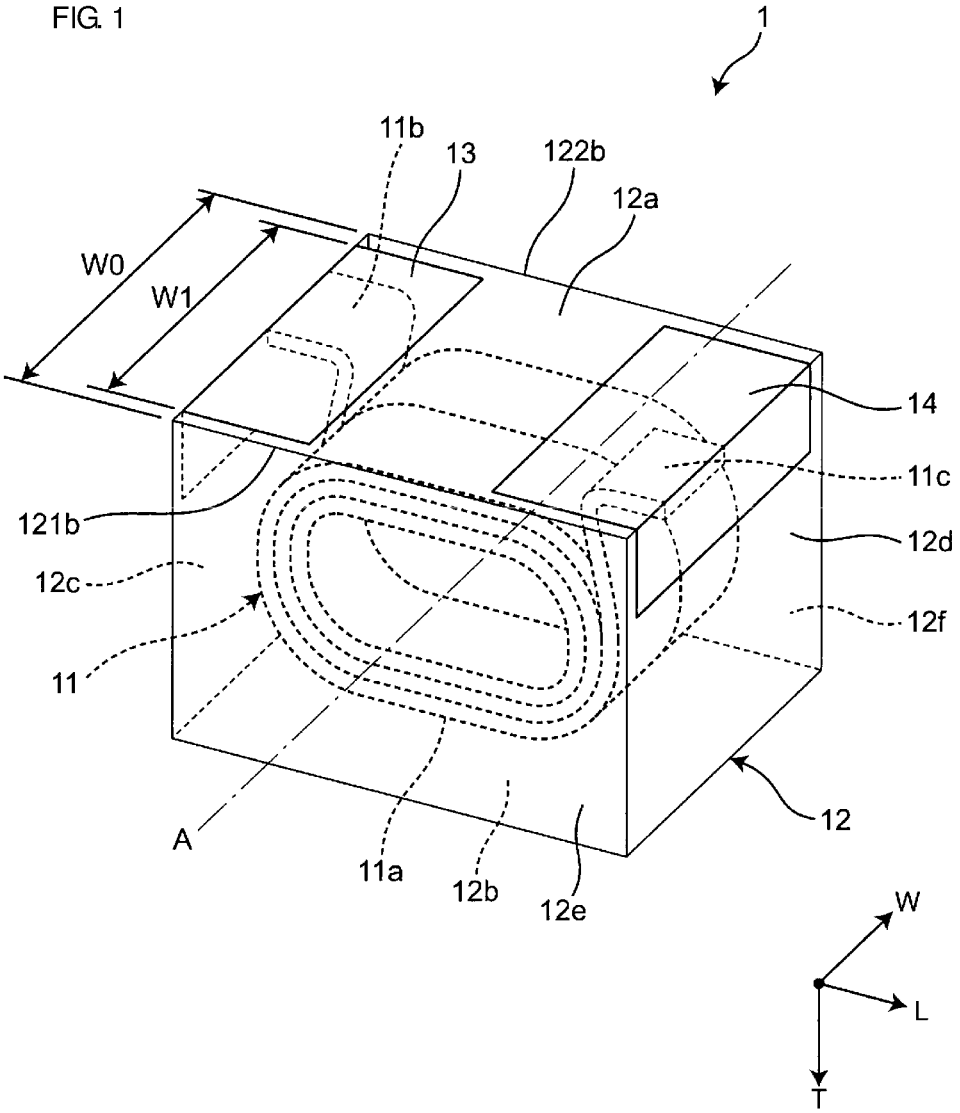
FIG. 1 is a schematic perspective view showing an example of the structure of a surface mount inductor according to an aspect of the present disclosure.

FIG. 1 is a schematic perspective view showing an example of the structure of a surface mount inductor 1 (hereafter also referred to as an inductor element) according to the present embodiment when viewed from the principal surface provided with outer terminals. The surface mount inductor 1 includes a molded body 12 containing a metal magnetic powder and a resin, and a coil 11 in which a conducting wire is wound is embedded in the molded body 12. FIG. 1 shows an example in which the molded body 12 is a substantially rectangular parallelepiped with a longitudinal direction L, a lateral direction W, and a height direction T. The molded body 12 has a first principal surface 12*a* and a second principal surface 12*b* as a pair of principal surfaces opposite to each other. The first principal surface 12*a* corresponds to a mounting surface (hereafter the first principal surface is also referred to as the mounting surface). The molded body 12 has four side surfaces consisting of a pair of side surfaces 12*c* and 12*d* opposite to each other in the longitudinal direction L of the first principal surface 12*a* and a pair of side surfaces 12*e* and 12*f* opposite to each other in the lateral direction W of the first principal surface 12*a*. The first principal surface 12*a* has a first ridge 121*b* that is located between the first principal surface 12*a* and the side surface 12*e* and that extends in the longitudinal direction and a second ridge 122*b* that is located between the first principal surface 12*a* and the side surface 12*f* and that extends in the longitudinal direction. The coil 11 is an air core coil and includes a winding portion 11*a*, in which the conducting wire is spirally wound in two stages while both ends are located on the outer circumference of the coil (α-winding), and a first extension portion 11*b* and a second extension portion 11*c* formed from the two ends of the conducting wire that extend from the opposing positions on the outer circumference of the winding portion 11*a*. The coil 11 is embedded in the molded body 12 such that the winding axis A of the winding portion 11*a* becomes parallel to the first principal surface 12*a* of the molded body 12. A flat type wire having a substantially rectangular cross section may be used for the conducting wire.

The first extension portion 11*b* extends through the molded body 12 and is bent such that the end portion is exposed at the first principal surface 12*a* and the top end surface is exposed at the side surface 12*c*. Meanwhile, the second extension portion 11*c* also extends through the molded body 12 and is bent such that the end portion is exposed at the first principal surface 12*a* and the top end surface is exposed at side surface 12*d*. Further, the end portion of the first extension portion 11*b*, part of which is exposed at the first principal surface 12*a*, is connected to a first outer terminal 13, and the end portion of the second extension portion 11*c*, part of which is exposed at the first principal surface 12*a*, is connected to a second outer terminal 14. The first outer terminal 13 and the second outer terminal 14 are disposed apart from each other in the longitudinal direction of the first principal surface 12*a*, the first outer terminal 13 is disposed over first principal surface 12*a* and the side surface 12*c*, and the second outer terminal 14 is disposed over the first principal surface 12*a* and the side surface 12*d*.

A resin coating serving as an insulating cover is formed on the surface of the molded body 12 except in regions in which the first outer terminal and the second outer terminal are provided. Meanwhile, the value of $W_1$ is less than the value of $W_0$, where the distance between a first ridge 121*b* and a second ridge 122*b* opposite to each other in the lateral direction of the first principal surface 12*a* of the molded body 12 provided with the resin coating is denoted as $W_0$ (hereafter also referred to as a width between ridges) and the dimension of the first outer terminal 13 or the second outer terminal 14 in the lateral direction of the first principal surface 12*a* is denoted as $W_1$ (hereafter also referred to as a width of the outer terminal), and neither end in the lateral direction of each of the first outer terminal 13 and the second outer terminal 14 is disposed in contact with the first ridge 121*b* or the second ridge 122*b*.

The molded body 12 contains a metal magnetic powder and a resin. Examples of the metal magnetic powder include metal magnetic powders with an iron base of, for example, Fe, Fe—Si, Fe—Si—Cr, Fe—Si—Al, Fe—Ni—Al, or Fe—Cr—Al, metal magnetic powders of an iron-free composition base, metal magnetic powders of another iron-containing composition base, metal magnetic powders in an amorphous state, metal magnetic powders having a surface covered with an insulator, for example, glass, metal magnetic powders having a modified surface, and fine nano-level metal magnetic powders. Examples of the resin used for the molded body 12 include thermosetting resins, for example, an epoxy resin, a polyimide resin, and a phenol resin, and thermoplastic resins, for example, a polyethylene resin and a polyamide resin, and mixtures of these may be used. Further, regarding the resin coating, an acrylic resin, an epoxy resin, a polyimide resin, a silicone resin, a polyamide resin, or the like may be used. Meanwhile, the first outer terminal 13 and the second outer terminal 14 are formed by using a conductor, for example, Cu, Ni, Sn, silver, an alloy containing silver, or the like and are composed of a single layer or a plurality of layers of conductive films. There is no particular limitation regarding the size of the molded body 12 as long as the size is suitable for surface mounting. For example, the size is set to be L=about 2.5 mm, W=about 2.0 mm, and T=about 2.0 mm The resin coating is formed so as to have a thickness of, for example, about 8 μm to 12 μm.

The surface mount inductor according to the present embodiment may be produced by using, for example, the following manufacturing method. The winding portion 11*a* shown in FIG. 1 is formed by spirally winding a conducting wire that is provided with an insulating cover and that has a substantially rectangular cross section in two stages while both ends of the conducting wire are located on the outer circumference. Subsequently, both ends of the conducting wire extend from opposing positions on the outer circumference of the winding portion so as to form the first extension portion 11*b* and the second extension portion 11*c* and to form the coil 11. Preferably, the resin used for the insulating cover has high heat resistance, and examples include a polyamide-based resin, a polyester-based resin, and an imide-modified-polyurethane resin. Regarding the conducting wire, a round wire having a substantially circular cross section or a wire having a substantially polygonal cross section may be used.

Then, a sealing material (hereafter referred to as a molded body material) is produced by mixing a metal magnetic powder and a resin. Examples of the metal magnetic powder include metal magnetic powders with an iron base of, for example, Fe, Fe—Si—Cr, Fe—Si—Al, Fe—Ni—Al, or Fe—Cr—Al, metal magnetic powders of an iron-free composition base, metal magnetic powders of another iron-containing composition base, metal magnetic powders in an amorphous state, metal magnetic powders having a surface covered with an insulator, for example, glass, metal magnetic powders having a modified surface, and fine nano-level metal magnetic powders. Regarding the resin, for example, an epoxy resin may be used. Then, the coil 11 is placed in a predetermined mold such that the winding axis becomes parallel to the mounting surface of the molded body, the mold is filled with the molded body material, and compression molding is performed. Consequently, as shown in FIG. 1, the molded body 12 in which the coil 11 is embedded is obtained. The molding method is not limited to the compression-molding method, and a compacting method may be used. In addition, burrs are removed by performing barrel polishing or the like so as to arrange the shape of the molded body.

A resin coating serving as an insulating cover is formed on the surface of the resulting molded body. Regarding the resin coating, an acrylic resin, an epoxy resin, a polyimide resin, a silicone resin, a polyamide imide resin, or the like may be used.

Subsequently, a resin component present on the surface of the portions, on which the outer terminals are to be formed, of the first principal surface 12*a* and the side surfaces 12*c* and 12*d* of the molded body 12 and the resin coating are removed by using a resin removal measure, for example, laser irradiation, blast treatment, polishing, or the like. Consequently, regions at which the metal magnetic powder is exposed are formed in the first principal surface 12*a* and the side surfaces 12*c* and 12*d* of the molded body 12. In addition, the insulating covers of the first extension portion 11*b* and the second extension portion 11*c* at the two ends of the coil 11 are removed by using the resin removal measure so as to expose the conducting wire.

Further, the molded body 12 is subjected to plating treatment so as to grow plating on the regions at which the metal magnetic powder is exposed and on the conducting wire of the first principal surface 12*a* and the side surfaces 12*c* and 12*d* of the molded body 12, thereby, forming the first outer terminal 13 and the second outer terminal 14. As a result, the first outer terminal 13 is connected to the end portion of the first extension portion 11*b* of the coil 11, and the second outer terminal 14 is connected to the end portion of the second extension portion 11*c* of the coil 11. In this regard, the first outer terminal 13 and the second outer terminal 14 are formed on the regions at which the metal magnetic powder is exposed and on the conducting wire of the mounting surface 12*a* and the side surfaces 12*c* and 12*d* of the molded body 12 by forming a first plating layer of Cu, forming thereon a second plating layer of Ni, and forming thereon a third plating layer of Sn. There is no particular limitation regarding the conductive material used for plating as long as the conductor is suitable for plating, and conductors other than Cu, Ni, and Sn, for example, silver and alloys containing silver, may be used. The order of the conductors used may be changed in accordance with the characteristics. The first outer terminal 13 and the second outer terminal 14 may be composed of a single layer, two layers, or three or more layers.

In the thus obtained surface mount inductor according to the present embodiment, the value of $W_1$ is less than the value of $W_0$, where the width between the first ridge 121*b* and a second ridge 122*b* opposite to each other in the width direction of the first principal surface 12*a* of the molded body 12 provided with the resin coating is denoted as $W_0$ (width between the ridges) and the dimension of the first outer terminal 13 or the second outer terminal 14 in the width direction of the first principal surface 12*a* is denoted as $W_1$ (width of the outer terminal), and neither end in the lateral direction of each of the first outer terminal 13 and the second outer terminal 14 is disposed in contact with the first ridge 121*b* or the second ridge 122*b*. The reason for this will be described below.

In the ridge portion of the molded body, the densities of the metal magnetic powder and the resin readily decrease, and the metal magnetic powder tends to fall during barrel polishing. When the metal magnetic powder falls, voids having a diameter of about 0.05 mm are generated on the surface of the molded body. If a resin coating serving as an insulating cover is formed on the surface of the molded body in such a state, the resin coating does not attach at the location of the voids because the voids resulting from falling of the metal magnetic powder are small, and the voids generated in the ridge portion of the molded body tend to remain. Consequently, in the case in which the outer terminal is formed by the plating method, so-called irregular plating deposition occurs such that a plating solution enters the voids and a conductor attaches to the voids. As a result, the insulation resistance in the vicinity of the ridge is reduced, and the withstand voltage of the surface mount inductor tends to decrease. On the other hand, when the width of the outer terminal is set to be narrower than the width between the ridges of the molded body provided with the resin coating and, in addition, both ends in the width direction of the outer terminal are set to be apart from the ridges of the molded body provided with the resin coating, the outer terminal is not readily affected by the insulation resistance in the vicinity of the ridge. Consequently, the withstand voltage of the surface mount inductor can be improved. In this regard, the withstand voltage in the present disclosure refers to a voltage at which dielectric breakdown between outer terminals on the surface of the molded body does not occur when the voltage is applied between the outer terminals and, therefore, the performance as the inductor is not lost.

Preferably, $W_1$ is about 55% or more and 95% or less (i.e., from about 55% to 95%) of $W_0$. More preferably, $W_1$ is about 58% or more and 90% or less (i.e., from about 58% to 90%) of W0. This is because if $W_1$ is less than about 55% of $W_0$, the connection strength of the outer terminal to the mounting surface is insufficient, and if $W_1$ is more than about 95% of $W_0$, the withstand voltage tends to decrease. For example, when the molded body provided with the resin coating has the size of L=about 2.5 mm, W=about 2.0 mm, and T=about 2.0 mm, W0 is about 2.0 mm. Therefore, in the case in which $W_1$ is about 55% or more and 95% or less of (i.e., from about 55% to 95%) $W_0$, $W_1$ is about 1.1 mm to 1.9 mm, and voids of about 0.05 mm to 0.45 mm are formed between the ridge and the outer terminal of the molded body provided with the resin coating.

Meanwhile, when a conductor is attached to at least one of the vicinity of the first ridge 121*b* of the first principal surface 12*a* and the vicinity of the second ridge 122*b*, it is also preferable that $W_1$ be about 55% or more and 95% or less (i.e., from about 55% to 95%) of $W_0$. In this regard, the conductor refers to at least one particle of the metal deposited due to irregular plating deposition during the above-described plating.

The outer terminals are to be disposed on at least the mounting surface, and it is preferable that the first outer terminal 13 and the second outer terminal 14 extend from the first principal surface 12*a* to the side surface 12*c* and the side surface 12*d*, respectively, which are adjacent to the first principal surface 12*a*, so as each to have a substantially L-shaped cross section, as shown in FIG. 1. Consequently, the adhesion strength between the outer terminal and the molded body can be further enhanced. Further, the end portion of the extension portion of the coil is to be exposed at least the first principal surface, and it is preferable that the top end surfaces of the end portions of the coil extension portions be exposed at the side surfaces 12*c* and 12*d* adjacent to the first principal surface 12*a* as shown in FIG. 1. The resistance between the end portion of the extension portion and the outer terminal can be reduced by increasing the connection area between the end portion of the extension portion and the outer terminal.

EXAMPLES

Experimental Example

In the present experimental example, the withstand voltage of an inductor element when the width of an outer terminal was changed relative to the width between ridges was evaluated. Regarding the inductor element used for the experimental example, the molded body provided with the resin coating had the size of L=2.5 mm, W=2.0 mm, and T=2.0 mm. The metal magnetic powder used for the molded body was Fe—Si—Cr, and the resin was an epoxy resin. An acrylic resin was used for the resin coating.

Method for Evaluating Critical Adhesion Force

The adhesion force was measured by mounting the inductor element on the board of a measurement jig, connecting the inductor element between the wires of the measurement jig board by soldering, and in this state, applying pressure in the direction parallel to the measurement jig board by a press jig on the basis of AEC-Q200. The critical adhesion force in the present example was denoted as the pressure at which the inductor element was broken or disconnected from the wire of the measurement jig board.

Method for Evaluating Critical Withstand Voltage

The withstand voltage was evaluated by performing a critical withstand voltage test for measuring the voltage at which the inductor element was broken by using an Impulsing Winding Tester (19301A produced by CHROMA JAPAN CORP.).

Results

Figure 2:
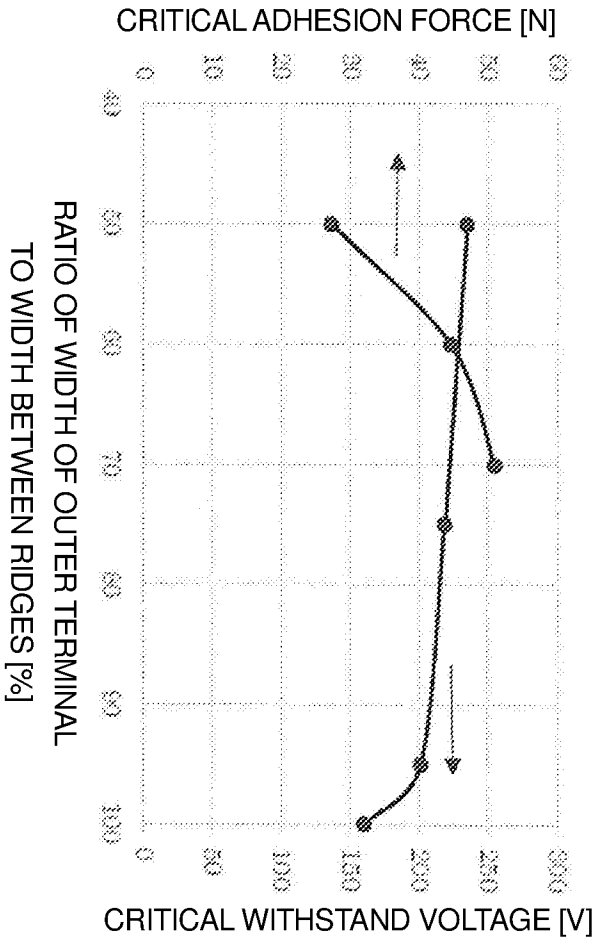
FIG. 2 is a graph showing the values of the critical adhesion force and the critical withstand voltage of a surface mount inductor when the width of an outer terminal is changed relative to the width between ridges.

FIG. 2 is a graph showing the measurement results of the critical adhesion force and the critical withstand voltage when the width of an outer terminal was changed relative to the width between ridges. When the width of the outer terminal was decreased relative to the width between the ridges, the critical withstand voltage increased but the critical adhesion force decreased. If the ratio of the width of the outer terminal to the width between the ridges was less than about 55%, the critical adhesion force required by AEC-Q200 was not satisfied. Therefore, the lower limit was set to be 55%. If the ratio of the width of the outer terminal to the width between the ridges was more than about 95%, regarding the ridges opposite to each other in the width direction of the first principal surface of the molded body provided with the resin coating, the critical withstand voltage decreased in the case in which the surface of the molded body was exposed at the resin coating or a conductor adhered. Therefore, the upper limit was set to be 95%.

In the above-described embodiment, the method in which the coil is embedded in the molded body such that the winding axis of the coil becomes parallel to the first principal surface serving as the mounting surface of the molded body is described as the method for exposing the extension portion of the coil at the surface of the mounting surface. However, in the present disclosure, other methods may be used. For example, a method in which the coil is embedded in the molded body such that the winding axis of the coil becomes perpendicular to the first principal surface serving as the mounting surface of the molded body and that the extension portion is twisted so as to be exposed at the mounting surface of the molded body may be used.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A surface mount inductor comprising:

a coil including a winding portion and first and second extension portions, the winding portion being formed by winding a conducting wire, and the first and second extension portions extending from the outer circumference of the winding portion;

a molded body which contains a metal magnetic powder and in which the coil is embedded, the molded body being in the shape of a rectangular parallelepiped having a first principal surface and a second principal surface opposite to each other and four side surfaces; and first and second outer terminals disposed on the molded body, wherein one end portion in the longitudinal direction of the first principal surface and a first side surface have the first outer terminal connected to an end portion of the first extension portion, and an other end portion and a second side surface have the second outer terminal connected to an end portion of the second extension portion, such that a surface of the end portion of the first extension portion that extends along the longitudinal direction of the first principal surface contacts a portion of the first outer terminal that extends along the longitudinal direction of the first principal surface, and a distal edge of the end portion of the first extension portion contacts a portion of the first outer terminal that extends in a direction along the first side surface, and a surface of the end portion of the second extension portion that extends along the longitudinal direction of the first principal surface contacts a portion of the second outer terminal that extends along the longitudinal direction of the first principal surface, and a distal edge of the end portion of the second extension portion contacts a portion of the second outer terminal that extends in a direction along the second side surface, a resin coating is formed on the surface of the molded body except in regions in which the first outer terminal and the second outer terminal are provided, and the value of $W_1$ is less than the value of $W_0$, where a width between a first ridge and a second ridge opposite to each other in a lateral direction of the first principal surface of the molded body provided with the resin coating is denoted as $W_0$, and a width of each of the first outer terminal and the second outer terminal in the lateral direction of the first principal surface of the molded body provided with the resin coating is denoted as $W_1$, and neither end in the width direction of each of the first outer terminal and the second outer terminal is in contact with the first ridge or the second ridge.

2. The surface mount inductor according to claim 1, wherein $W_1$is from 55% to 95% of $W_0$.

3. The surface mount inductor according to claim 2, wherein a conductor is attached to at least one of the vicinity of the first ridge and the vicinity of the second ridge.

4. The surface mount inductor according to claim 2, wherein the coil is embedded in the molded body such that a winding axis of the coil becomes parallel to the first principal surface of the molded body.

5. The surface mount inductor according to claim 3, wherein the coil is embedded in the molded body such that a winding axis of the coil becomes parallel to the first principal surface of the molded body.

6. The surface mount inductor according to claim 1, wherein the coil is embedded in the molded body such that a winding axis of the coil becomes parallel to the first principal surface of the molded body.

* * * * *